United States Patent [19]

Cristiani

[11] Patent Number: 4,505,280

[45] Date of Patent: Mar. 19, 1985

[54] DEVICE FOR WRAPPING A JUNCTION BAND AROUND A PAIR OF CIGARETTES

[75] Inventor: Athos Cristiani, Bologna, Italy

[73] Assignee: Sasib S.p.A., Bologna, Italy

[21] Appl. No.: 497,070

[22] Filed: May 20, 1983

[30] Foreign Application Priority Data

Jun. 2, 1982 [IT] Italy ..... 12556 A/82

[51] Int. Cl.[3] ..... A24C 5/47

[52] U.S. Cl. ..... 131/94; 131/88; 131/93; 131/95; 131/282

[58] Field of Search ..... 131/94, 88, 93, 95, 131/282

[56] References Cited

U.S. PATENT DOCUMENTS 3,483,873 12/1969 Hivzmann ..... 131/94

3,506,017 4/1970 Schubert ..... 131/94

FOREIGN PATENT DOCUMENTS 0872047 7/1961 United Kingdom ..... 94/

*Primary Examiner*—V. Millin

*Attorney, Agent, or Firm*—Spencer & Frank

[57] ABSTRACT

A device for wrapping a glued junction band (T) around an axially arranged pair of cigarettes (S) with a double filter interposed therebetween, wherein the cigarettes and filters are aligned by terns on a rotary drum (1) comprising rolling sectors defined between peripheral gabled ridges (2) on the periphery of the drum. In each of said sectors, the axial rolling movement of a tern comprising the cigarettes and double filter, which promotes the wrapping of the junction band (T) therearound, is caused by a relative sliding movement between the periphery of the drum (1) and an endless chain-track (3), the articulated links (11) of which comprise, each, an arcuated rolling face or sole (111) and are positively guided, perfectly concentrically with the drum (1), along a pre-determined angle thereof, depending upon the length of the band and upon the rate of the relative movement, the radial constant spacing between the soles (111) and the opposite rolling sectors of the drum (1) being such as to engage laterally, by a gentle pressure, the terns to be wrapped in the respective band (T). Each of said rolling faces or soles (111) of the chain-track links (11) has an inlet sharp corner (211), on the upstream side of the rolling sole, with respect to the direction of the peripheral movement of the drum (1), so as to form an abutment shoulder to align the terns of cigarettes (S) and interposed double filter, if necessary and before they begin rolling, and to make sure that the rolling movement of the terns begins with each tern in perfect alignment.

4 Claims, 3 Drawing Figures

DEVICE FOR WRAPPING A JUNCTION BAND AROUND A PAIR OF CIGARETTES

SUMMARY OF THE INVENTION

This invention relates to the manufacture of filter-tipped cigarettes by the so-called assembling method, comprising the steps of initially forming axially aligned terns each including two cigarettes and one double filter interposed therebetween, and successively joining said filter to the facing ends of the cigarettes of said tern by means of a glued junction band or sticker that is wrapped up by being rolled around the intermediate portion of said tern.

Said wrapping of the junction band is obtained by laterally placing the band against the tern and, thereafter, by rolling the tern as a unit around its axis so as to cause the band to wrap therearound.

In order to effect the wrapping of the junction band around the double filter and adjacent ends of the two aligned cigarettes of the tern, the terns are orderly arranged on a drum formed of rolling sectors and are then contacted with a gentle pressure against a contrasting surface, which is co-axial with the drum, along an arc commensurate with the length of the band to be wrapped up, related to the relative sliding movement between the rolling sector and a contrasting surface, said relative sliding movement causing the desired axial rolling motion of the tern, as needed to effect a complete wrapping of the band therearound.

In order to effect this wrapping up of a junction band, rolling devices are known wherein said contrasting surface, cooperating to carry out the rolling of the terns on the respective rolling sectors of the drum, comprises one or more controlled-movement endless belts that are guided substantially concentrically with the drum along the required arcuate extent and are moved in the same direction of rotation as the drum, however, with a smaller peripheral speed.

These rolling devices with a mobile contrasting surface have the advantage, with respect to those with a stationary contrasting surface, to allow a longer wrapping time, with a same rotational speed of the rolling drum, thus permitting a smaller angular rolling speed of the axially aligned terns, each formed by two cigarettes and one interposed double filter.

Therefore, these rolling devices with a mobile contrasting belt permit very high production rates, taking advantage of the differential speed, or sliding, between the belt and the drum, and of the respective arcuate extent wherealong the junction band is wrapped around the aligned tern of the cigarettes and interposed double filter.

However, these rolling devices with a mobile contrasting belt have some disadvantages, concerning particularly the alignment of the terns of the cigarettes and filter before the rolling thereof, and concerning the uniformity of the rolling pressure of the contrasting belt.

As to the axial alignment of the two cigarettes and double filter of each tern, if it has not been previously effected and stabilized by the junction with the leading end of the band to be wrapped, it implies the provision of suitable means to axially align the two cigarettes and double filter before beginning the rolling of the tern.

In a conventional embodiment, such an aligning means comprises toothed discs cooperating with the ridges on the rolling drum.

As to the uniformity of the rolling pressure of the contrasting belt against the terns, it is to be noted that said belt is maintained substantially concentrical with the rolling sectors drum (which, more approximately, is a polygonal drum) by the action of the terns being rolled, whereby said pressure cannot be uniform, firstly, due to this polygonal shape, which shape can also become of irregular configuration when one or more terns on the drum are missing because they have been discarded due to any defects.

In order to relieve the consequences of the polygonal configuration of the contrasting belt on the uniformity of the rolling pressure on the terns, it has been proposed to make the contrasting belt of a material which is elastic radially of the rolling drum, so as to avoid distorting the terns being rolled, and is unelastic in the direction of movement of the belt, so as to avoid any irregularity in the wrapping up of the glued bands as a result of the alternate tensioning and slackening of the contrasting belt.

When one or more defective terns have been discharged from the rolling drum, if the contrasting web were elastic also in the direction of its movement, it would be tensioned by the friction engagement with the surface of the rolling section of the drum, or with the interspaced ridges, if provided, and it would then become slackened upon disengagement therefrom, when the terns will be fed again regularly. This is the cause of said irregular rolling of the terns.

To overcome the mentioned drawback of the defective concentricity of the endless contrasting web with respect to the rolling drum, and, therefore, of the non-uniform compressive action of the web on each tern of two cigarettes and interposed double filter, a flexible and unextensible contrasting web of ferro-magnetic material, or of rubber with ferro-magnetic inserts has been proposed, which is kept in adherence with a sole which is concentric with the drum by means of a plurality of permanent magnets, inter-spaced along the arcuate extent of the sole.

As an alternative to the permanent magnets, the contrasting endless web may be kept in adherence to said sole by pneumatic or mechanical means.

The endless contrasting belts of the just-mentioned type require, generally, the contemporary use of the specified means to align the two cigarettes and the double filter of a tern.

The object of this invention is to provide a means to wrap up a glued junction band around an axial pair of cigarettes with interposed double filter, the cigarettes and filter being orderly aligned by terns on a rotary drum formed of rolling sectors cooperating with a co-axial contrasting means adapted to engage the terns with a relative sliding movement with respect to the drum, so as to make them roll around their axes, whereby the band is wrapped therearound, wherein said contrasting means comprises an endless chain-track formed of articulated links each including an arcuate rolling shoe and positively guided concentrically with the drum, along a pre-determined angle thereof, depending upon the length of the band to be wrapped up and the relative sliding speed between the chain track and the drum, the constant radial spacing between the track shoes and opposite rolling sectors of the drum being such as to laterally engage, sequentially and by a gentle pressure, the axial terns of cigarettes and filter to be wrapped by the respective junction band.

In the rolling device according to the invention, each of said arcuate rolling track shoes has an inlet sharp corner at the upstream side of the shoe, with respect to the direction of the peripheral movement of the drum, said corner constituting an abutment shoulder to bring into alignment, if required and before beginning the rolling step, the terns of two cigarettes and one interposed double filter, and to make sure that, anyway, the rolling action begins with each tern in perfect alignment.

BRIEF DESCRIPTION OF THE DRAWINGS

These and other features of the invention, and the advantages resulting therefrom, will be apparent from the following detailed description of a preferred embodiment thereof, made as a non-limitating example, with reference to the accompanying drawings, wherein.

DESCRIPTION OF THE PREFERRED EMBODIMENT

With reference to the drawings, generally in the numerical order of the Figures, the rolling sectors drum 1, carrying the ranked terns of cigarettes and double filters, is a conventional drum provided with peripheral ridges 2 angularly equally spaced from each other, parallel to the rotational axis of the drum, and defined by concave sides 102, 202 giving the ridges the shape of a gable or cusp.

Figure 1:
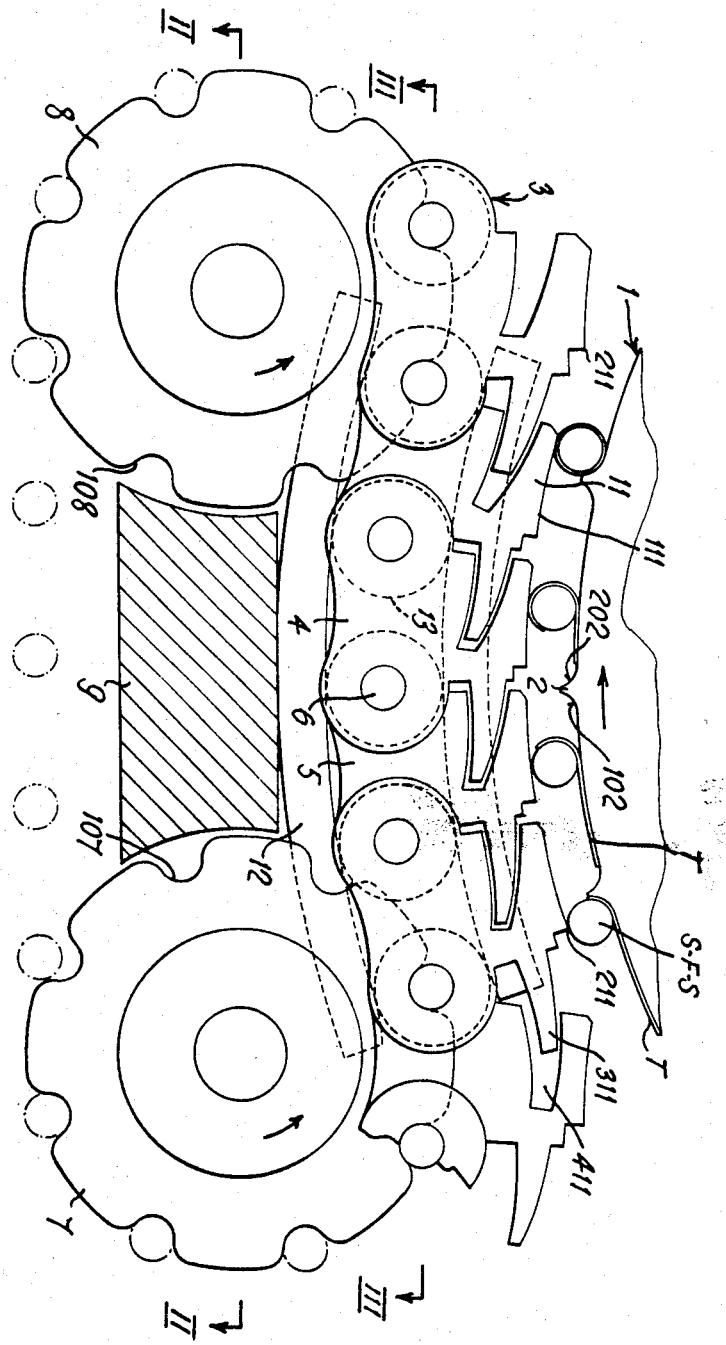
FIG. 1 is a side elevational view of a preferred embodiment of the device according to the invention, to wrap up a glued junction band into position around the central portion of an axial tern comprising two cigarettes and one interposed double filter.

Before the rolling step, each pair of cigarettes S and double filter F (the tern S-F-S, FIG. 1) is adjacent the side 102 of a ridge 2, with the leading end of a glued junction band T already sticked to the filter F and abutting ends of the two cigarettes S.

The endless chain-track 3 cooperating sequentially with the drum 1 to roll each tern and cause the respective junction band T to wrap up therearound, is comprised of links 4, 5 interconnected by pivots 6 which engage with the recesses 107 of the driving sprocket 7 and recesses 108 of the driven sprocket 8.

The operative assembly of the track 3, supported as described and moved on the sprockets 7 and 8, is carried by a cantilevered member 9 fixed to the side frame 10 of the machine.

Each of the links 4,5 of the track 3 comprises a shoe 11 which includes a rolling surface, or sole, 111 having a radius $R=R_1+d$, wherein $R_1$ is the radius of the drum 1 and d is a length slightly smaller than the diameter of the cigarettes S and filter F.

Figure 2:
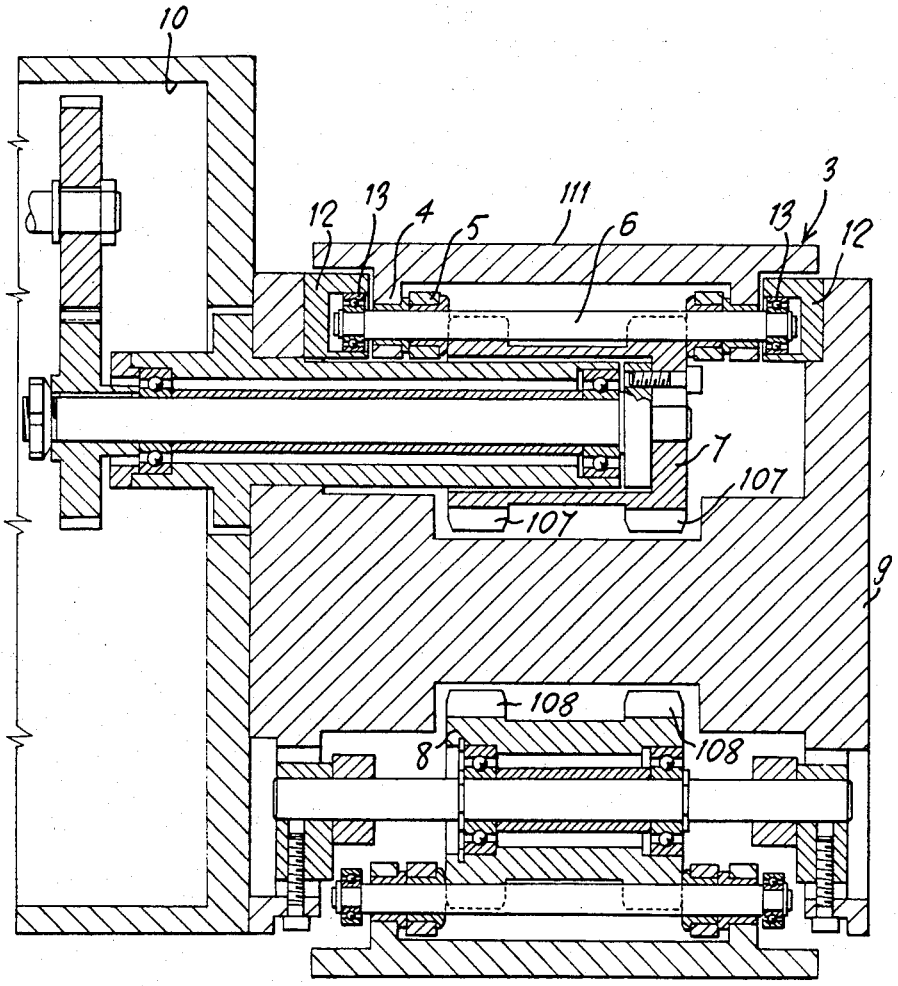
FIG. 2 is a cross-sectional view on the lines II—II of FIG. 1.
Figure 3:
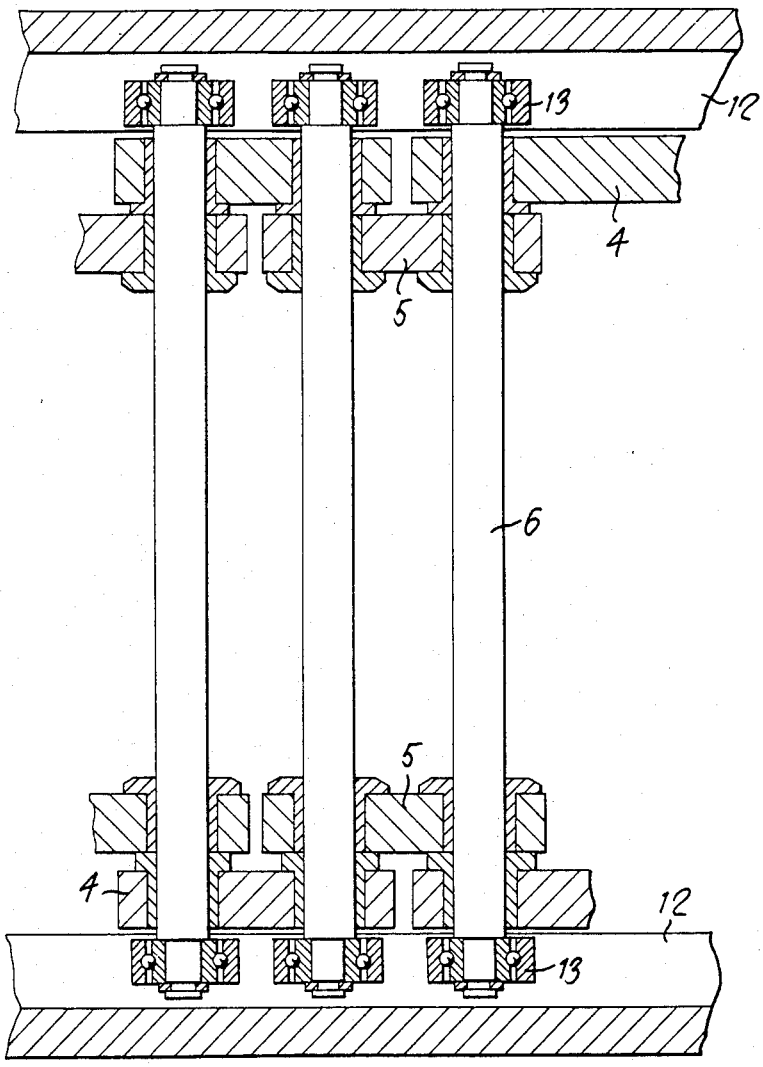
FIG. 3 is a cross-sectional view on the lines III—III of FIG. 1.

The shoes 11 of the active run of the chain-track 3 are kept concentric with the drum 1, along a certain sector, at a distance d therefrom, by means of a pair of guides 12 engaging the ball-bearings 13 rotatably arranged at the ends of the pivots 6 (see FIGS. 2 and 3).

The edge of the arcuate rolling surface 111 of the shoe 11, upstream with respect to the direction of rotation of the drum 1, has a sharp corner 211, while the downstream edge is beveled.

Each shoe 11 comprises a cantilevered portion 311, shaped as an arcuate wedge, and a conforming recess 411, similarly shaped as an arcuate wedge, the portion 311 and recess 411 being in opposite symmetrical position in a shoe 11.

The cantilevered portion 311 of each shoe 11 is slidingly engaged in the recess 411 of the adjacent upstream shoe, while the recess 411 of the shoe 11 receives the cantilevered portion 311 of the adjacent downstream shoe 11.

This chain-like interconnection of the shoes 11 of the track 3 with sliding reception of the arcuate-wedge portion 311 into the confronting recesses 411 of the shoes aims to avoid that rambling parts, such as pieces of filters, of cigarettes, or the like, are caught and crushed between adjacent shoes 11 of the track 3, which are angularly spaced from each other at the sprocket 7 and are close to each other along the guided run which is concentric with the drum 1.

This rolling device for wrapping a glued junction band around an axial pair of cigarettes with interposed double filter operates as follows:

The chain-track 3 is operated at a speed which is lower than the peripheral speed of the drum 1 and concomitant therewith along the said rolling arc, where the path of movement of the track is concentric with the drum.

The ranked "cigarette/double filter/cigarette" terns, already joined to the leading end of the associated glued junction band T, are laid, each with an in-line arrangement and adjacent to the side 102 of a ridge 2 of the drum 1.

The sequential rolling of each so-arranged tern begins when the tern engages with the edge 211 of a shoe 11.

Since the distance between the rolling surface of the drum 1 and that of the shoe 11 is smaller than the diameter of the cigarettes and filters, and since the speed of the chain-track 3 is lower than that of the drum 1, the corner 211 functions as an abutment shoulder to axially align accurately the two cigarettes and interposed filter of each tern when the latter passes therebeyond, at the moment they begin rolling and, therefore, the junction band begins wrapping therearound.

On completion of the rolling operation, the junction band will be completely wrapped around the tern, and the wrapped up tern will be now in engagement with the side 202 of the ridge 2.

Even if the two cigarettes S and double filter F of each tern S-F-S have not been previously aligned and sticked to the leading end of the junction band T, it is apparent that the sidewise impact of the tern against the inlet abutment 211 of the contrasting shoe 11 will effect the alignment thereof prior to its sticking to the leading end of the band.

Obviously, the invention is not limited to the embodiment just shown and described by way of example, but changes and modifications can be broadly made thereto, especially depending upon the particular requirements of each specific practical case, without departing from broadest scope of the inventive principle, as set forth above and claimed hereinafter.

I claim:

1. A rolling device for wrapping a glued junction band into position around an axial tern formed of two cigarettes and one double filter interposed therebetween, said terns being orderly ranked on a rotary drum formed of rolling sectors, adapted to cooperate with a co-axial contrasting means capable of engaging said terns sequentially with a relative sliding movement with respect to the drum, so as to make them roll around themselves at least as necessary to make said band wrap up therearound, characterized in that said contrasting means comprises an endless chain-track formed of articulated links, each link including an arcuate rolling sole, said links being positively driven concentrically with the drum along a pre-determined angular extent of the drum, depending upon the wrapping length of said band or sticker, and upon the relative sliding speed between the chain-track and the drum, the constant radial spacing between the soles of the chain-track and the opposite rolling sectors of the drum being just smaller than the diameter of the cigarettes and filter of the tern to be joined, so as to laterally engage the terns by a gentle pressure while they are being rolled to be wrapped by the respective glued junction band.

2. A rolling device for wrapping a glued junction band around an axial tern of two cigarettes and one double filter interposed therebetween, with a rotary drum formed of rolling sectors and a contrasting surface formed of a chain-track comprised of articulated links and positively driven co-axially with the drum, according to claim 1, characterized in that each of said arcuate rolling soles of said chain-track has an inlet sharp corner at the upstream side of the sole, with respect to the peripheral rotational movement of the drum, said sharp corner forming an abutment shoulder to align, if necessary and before beginning the rolling step, the terns of two cigarettes and double filter, and to make sure that, anyway, the rolling step begins with each tern in perfect alignment.

3. A rolling device for cigarettes-and-filter terns, with a chain-track including shoes with curved soles, according to claim 2, characterized in that said shoes comprise cantilevered curved portions and complementary recesses, said curved portions and recesses inter-engaging with each other, between the adjacent articulated shoes of the chain-track so as to cover the arc of pivotal movement of said shoes on the guide means for the chain-track.

4. A rolling device for cigarettes-and-filter terns, with a chain-track including shoes with curved soles, according to claim 1, characterized in that said shoes comprise cantilevered curved portions and complementary recesses, said curved portions and recesses inter-engaging with each other between the adjacent articulated shoes of the chain-track so as to cover the arc of pivotal movement of said shoes on the guide means for the chain-track.

* * * * *